US011047139B2

(12) United States Patent
Erickson et al.

(10) Patent No.: US 11,047,139 B2
(45) Date of Patent: Jun. 29, 2021

(54) VENEER PROFILE WITH FASTENING FEATURE AND RELATED METHODS

(71) Applicant: Schluter Systems L.P., Plattsburgh, NY (US)

(72) Inventors: Kyle Erickson, Plattsburgh, NY (US); K. Bradley Van Brunt, Jr., Plattsburgh, NY (US); Roy A. Zalis, Plattsburgh, NY (US); Peter Plank, Plattsburgh, NY (US)

(73) Assignee: Schluter Systems L.P., Plattsburgh, NY (US)

( * ) Notice: Subject to any disclaimer, the term of this patent is extended or adjusted under 35 U.S.C. 154(b) by 0 days.

(21) Appl. No.: 16/506,857

(22) Filed: Jul. 9, 2019

(65) Prior Publication Data

US 2021/0010278 A1 Jan. 14, 2021

(51) Int. Cl.
*E04F 19/06* (2006.01)
*E04F 11/16* (2006.01)

(52) U.S. Cl.
CPC ..... *E04F 19/061* (2013.01); *E04F 11/163* (2013.01); *E04F 11/166* (2013.01)

(58) Field of Classification Search
CPC ..... E04F 19/061; E04F 11/163; E04F 11/166; F16B 15/00; F16B 19/14
USPC ..... 411/493, 498, 499
See application file for complete search history.

(56) References Cited

U.S. PATENT DOCUMENTS 718,821 A * 1/1903 Cooper
RE17,205 E * 2/1929 Loehr
1,767,782 A * 6/1930 Awbrey
2,203,294 A * 6/1940 Engle ..... F16B 15/0092 411/487
2,843,889 A 7/1958 Keller
3,448,494 A 6/1969 Boyenval et al.
3,516,111 A * 6/1970 Heyman ..... F16L 5/00 16/2.1
3,788,655 A * 1/1974 Hathaway ..... F16L 5/10 277/637
4,067,155 A 1/1978 Ruff et al.
(Continued)

FOREIGN PATENT DOCUMENTS

DE 0233487 A2 * 8/1987
DE 9317920 U1 * 2/1994
(Continued)

*Primary Examiner* — Adriana Figueroa
(74) *Attorney, Agent, or Firm* — Jason R. Jones

(57) ABSTRACT

An elongate profile for terminating a veneer component includes a fastening leg configured to be installed against a base surface. An edge leg extends from the fastening leg and is configured to provide a covering edge for a veneer component installed against the fastening leg. The fastening leg includes at least one fastener opening formed therethrough, the fastener opening configured to receive a fastener therethrough such that the fastener can couple the fastening leg to the base surface as it extends through the fastener opening and engages the base surface. A deformation region is formed in the fastening leg adjacent the fastener opening and is operable to deform as the fastener is driven into the base surface through the fastener opening such that at least a portion of material of the deformation zone extends into the base surface as the fastener is driven into the base surface.

17 Claims, 5 Drawing Sheets

(56) References Cited

U.S. PATENT DOCUMENTS 4,157,271 A 6/1979 Moore
4,385,431 A 5/1983 Holton
4,580,383 A * 4/1986 Pittman ..... E04D 1/08 52/520
D299,273 S 1/1989 Pittman, Jr.
5,207,535 A 5/1993 Saab
5,289,663 A 3/1994 Schluter
5,433,986 A 7/1995 Moscatello
5,502,942 A * 4/1996 Gras ..... B60R 13/0206 24/295
D373,203 S 8/1996 Kornfalt et al.
5,620,290 A 4/1997 Homfeldt et al.
5,678,380 A 10/1997 Azzar
5,775,862 A 7/1998 Cullen
5,806,253 A * 9/1998 Nelson ..... E04F 11/166 52/179
5,915,903 A 6/1999 Osterle et al.
D418,352 S 1/2000 Cadorette
6,141,920 A * 11/2000 Kemper ..... E04F 19/063 52/179
6,167,667 B1 1/2001 Balaban
6,171,042 B1 1/2001 Olvera et al.
6,193,455 B1 2/2001 Levey
6,238,773 B1 5/2001 Schluter
6,286,286 B1 9/2001 Simonar
6,338,229 B1 * 1/2002 Botzen ..... E04F 13/06 52/287.1
D471,794 S 3/2003 Wall
6,647,680 B2 11/2003 Daly et al.
6,672,814 B1 1/2004 Kotlarski
6,705,813 B2 3/2004 Schwab
6,805,525 B2 * 10/2004 Oswald ..... F16B 19/14 411/440
D498,004 S 11/2004 Smith
D504,181 S 4/2005 Stanchfield
D522,147 S 5/2006 Morton et al.
D523,565 S 6/2006 Antonic
7,065,931 B2 6/2006 Kornfalt et al.
D529,630 S 10/2006 Zarb
7,202,762 B2 4/2007 Luh
D543,287 S 5/2007 Neuhofer, Jr.
D552,269 S 10/2007 Vibiano
7,284,940 B2 * 10/2007 Lee ..... F16B 15/00 411/447
7,389,613 B2 * 6/2008 Sondermann ..... E04F 19/061 52/179
7,409,802 B2 8/2008 Fiedler
D621,076 S 8/2010 Vibiano
D621,961 S 8/2010 Gardner
7,784,238 B2 8/2010 Bannister
7,963,498 B2 6/2011 Seymour et al.
D679,419 S 4/2013 Gori et al.
8,568,073 B2 10/2013 Eberle et al.
D695,099 S 12/2013 MacLellan et al.
8,695,303 B2 * 4/2014 Swanson ..... E04D 3/24 52/478
8,739,470 B1 6/2014 Wayne et al.
8,764,362 B2 7/2014 Siegal
D711,556 S 8/2014 Singh
D713,060 S 9/2014 Irving et al.
8,920,089 B1 12/2014 Stewart
9,121,186 B2 * 9/2015 Mensah
D742,564 S 11/2015 Singh
D750,806 S 3/2016 Singh
9,481,047 B2 11/2016 Hassan
9,651,083 B2 5/2017 Bizzini
9,746,018 B2 8/2017 Williams et al.
9,841,047 B2 12/2017 Porter
2004/0128943 A1 7/2004 Herbert
2004/0163343 A1 8/2004 Crocenzi
2005/0229517 A1 10/2005 Gomez Insa
2006/0150539 A1 7/2006 Vanhastel et al.
2007/0122252 A1 * 5/2007 Bosacco ..... F16B 15/00 411/487
2008/0172961 A1 7/2008 Wu
2011/0283636 A1 11/2011 Vanhastel
2012/0110941 A1 5/2012 Biro et al.
2014/0174005 A1 6/2014 Richard et al.

FOREIGN PATENT DOCUMENTS

DE 19544648 C1 * 4/1997
DE 0972887 A1 * 1/2000
DE 29921912 U1 * 3/2000
DE 10040489 A1 * 3/2002
DE 102013209232 A1 * 12/2014
FR 0651109 A1 * 5/1995

* cited by examiner

VENEER PROFILE WITH FASTENING FEATURE AND RELATED METHODS

BACKGROUND OF THE INVENTION

Field of the Invention

The present invention relates generally to profiles used to provide a finished edge to veneer materials.

Related Art

Profiles have been used for some time to provide an aesthetically appealing and structurally sound edge for veneer components. While such profiles are known in the art, existing profiles suffer from a variety of problems. In particular, it can be difficult to properly position some profiles atop some base surfaces and beneath some veneer components during installation of the materials.

SUMMARY OF THE INVENTION

In accordance with one aspect of the technology, an elongate profile for terminating a veneer component is provided. The profile can include a fastening leg configured to be installed against a base surface. An edge leg can extend from the fastening leg and can be configured to provide a covering edge for a veneer component installed against the fastening leg. The fastening leg can include at least one fastener opening formed therethrough. The fastener opening can be configured to receive a fastener therethrough such that the fastener can couple the fastening leg to the base surface as it extends through the fastener opening and engages the base surface. A deformation region can be formed in the fastening leg adjacent the fastener opening. The deformation region can be operable to deform as the fastener is driven into the base surface through the fastener opening such that at least a portion of material of the deformation zone extends into the base surface as the fastener is driven into the base surface.

In accordance with another aspect of the technology, an elongate profile for terminating a veneer component is provided, including a fastening leg configured to be installed against a base surface. An edge leg can extend from the fastening leg and can be configured to provide a covering edge for a veneer component installed against the fastening leg. The fastening leg can include at least one fastener opening formed therethrough. The fastener opening can be configured to receive a fastener therethrough such that the fastener can couple the fastening leg to the base surface as it extends through the fastener opening and engages the base surface. A deformation region can be formed in the fastening leg adjacent the fastener opening. The deformation region can be operable to deform as the fastener is driven into the base surface through the fastener opening such that at least a portion of material of the deformation zone extends into the base surface as the fastener is driven into the base surface. The deformation region can include a series of teeth extending from an outer section of the deformation region inwardly toward the fastener opening. The deformation region can include a flat profile prior to introduction of the fastener through the fastener opening such that substantially all material of the deformation region is flush with or above a lower surface of the fastener leg prior to engagement of the base surface with the fastener.

In accordance with another aspect of the technology, a method is provided of installing an elongate profile for terminating one or more veneer components above a base surface. The method can include positioning a fastening leg of the profile against a base surface, the profile including an edge leg extending from the fastening leg and being configured to provide a covering edge for a veneer component installed against the fastening leg. The fastener can be installed into the base surface through a fastener opening formed through the fastening leg. A head of the fastener can engage a deformation region formed in the fastening leg adjacent the fastener opening to thereby deform at least a portion of the deformation region as the fastener is driven into the base surface through the fastener opening such that at least a portion of material of the deformation region extends into and engages the base surface as the fastener is driven into the base surface.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 1A:
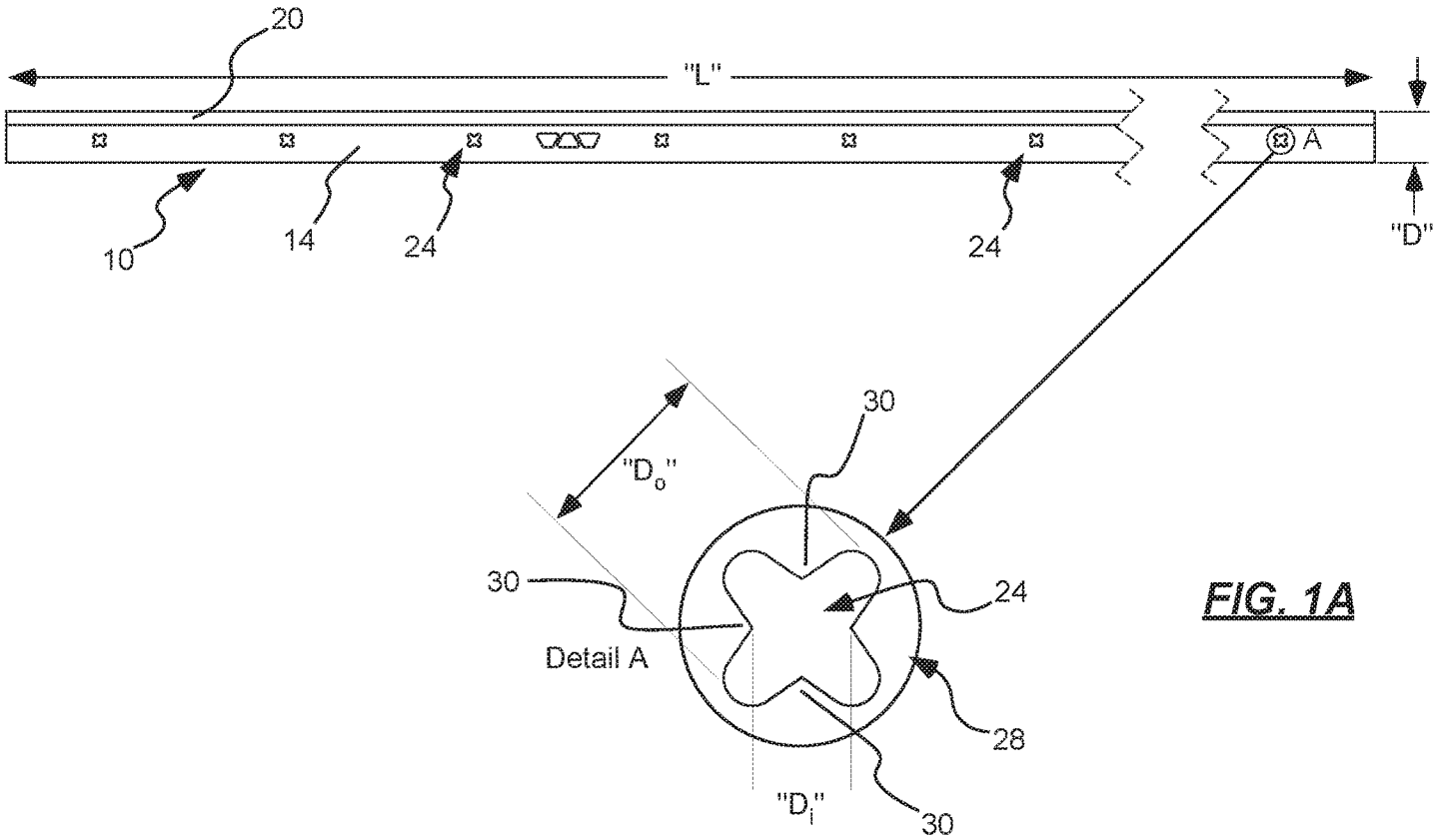
FIG. 1A is a top view of a profile in accordance with an aspect of the technology.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Definitions

As used herein, the singular forms "a" and "the" can include plural referents unless the context clearly dictates otherwise. Thus, for example, reference to "a fastener opening" can include one or more of such openings, if the context so dictates.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms can sometimes be used herein to describe and claim various components of the present invention. Such terms include, without limitation, "upward," "downward," "horizontal," "vertical," etc. These terms are generally not intended to be limiting, but are used to most clearly describe and claim the various features of the invention. Where such terms must carry some limitation, they are intended to be limited to usage commonly known and understood by those of ordinary skill in the art in the context of this disclosure. In some instances, dimensional information may be included in the figures. This information is intended to be exemplary only, and not limiting. In some cases, the drawings are not to scale and such dimensional information may not be accurately translated throughout the figures.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Invention

The present technology relates generally to profile systems used to terminate edges of veneer components installed against base surfaces. Examples of veneer materials with which the present technology can be beneficially used include, without limitation, vinyl flooring or wall products, wood or simulated wood flooring or wall products, ceramic, stone or porcelain tiles, etc. Generally, the present profiles are designed to be fastened to a base surface, after which a veneer material is installed above a leg of the profile.

Figure 1B:
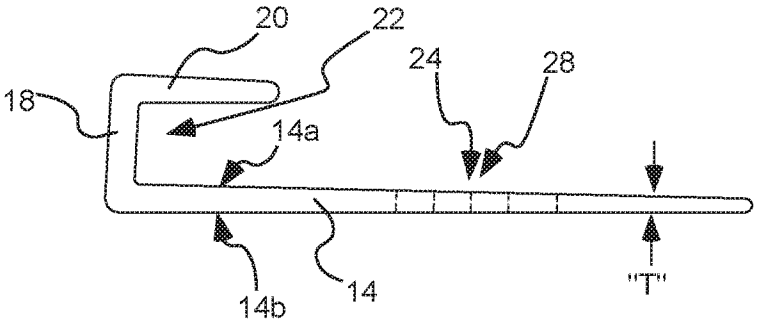
FIG. 1B is an end view of the profile of FIG. 1.

FIGS. 1A and 1B illustrate an exemplary embodiment of the present technology. In this example, an elongate profile 10 is provided for terminating a veneer component or material (12 in FIG. 2). The profile can include a fastening leg 14 that can be configured to be installed against a base surface (16 in FIG. 2). The base surface can be, for example, a subfloor, a stair riser, a stair tread, a countertop, etc. Generally, the base surface is formed from a material suitable for receiving a threaded fastener (see 26, for example, in FIGS. 2, 3A, 4A, 5, 6 and 7) therein, such as wood, composite materials, etc. Generally, the fastening leg 14 is installed against the base surface 16, after which the veneer component 12 is installed against the base surface and against (or atop, in a horizontal installation) the fastening leg 14.

The profile 10 can also include an edge leg 18 that can extend from the fastening leg. The edge leg can be configured to provide a covering edge for the veneer component installed against the fastening leg. The edge leg can serve to both provide an aesthetically pleasing finished edge to the veneer material and to provide a structurally sound edge that is more durable than the generally unfinished edge of the veneer component. In some embodiments, the profile 10 can also include a cover leg 20. The cover leg can extend from the edge leg 18 in a direction substantially parallel with the fastening leg 14. In this manner, the cover leg and the fastening leg can collectively define a receiving pocket 22 in which the veneer component 12 can be positioned. As the veneer component is positioned within the receiving pocket, adhesive 38 (FIG. 2) can attach the veneer component to the base surface 16. In this arrangement, the fastening leg, edge leg and cover leg create an envelope in which an unfinished edge of the veneer component or material is secured once the installation is complete.

The fastening leg 14 can include at least one fastener opening 24 formed therethrough. The fastener opening can be configured to receive a fastener 26 therethrough such that the fastener can couple the fastening leg to the base surface 16 as it extends through the fastener opening and engages the base surface. A variety of fasteners can be used with the present technology, but in one embodiment the fastener can include threads that threadably engage the base surface against which the fastening leg is installed. The type of fastener can be selected based upon the material from which the base surface is formed. In the case the base surface is wood, or a similar material, the fastener can be a wood screw.

The fastening leg 14 can include a deformation region or zone 28 formed therein. The deformation region, which may or may not be visible from casual inspection of the fastening leg, can be formed in an area adjacent to or surrounding the fastener opening 24. The deformation region is generally operable to deform as the fastener 26 is driven into the base surface 16 through the fastener opening. In this manner, at least a portion of material of the deformation region can extend into the base surface as the fastener is driven into the base surface. As the material of the deformation region is forced into the base surface by the fastener, a secure interface is created between the fastening leg and the base surface. This can aid in preventing unwanted movement of the fastening leg relative to the base surface during or after installation of the veneer component 12.

Figure 2:
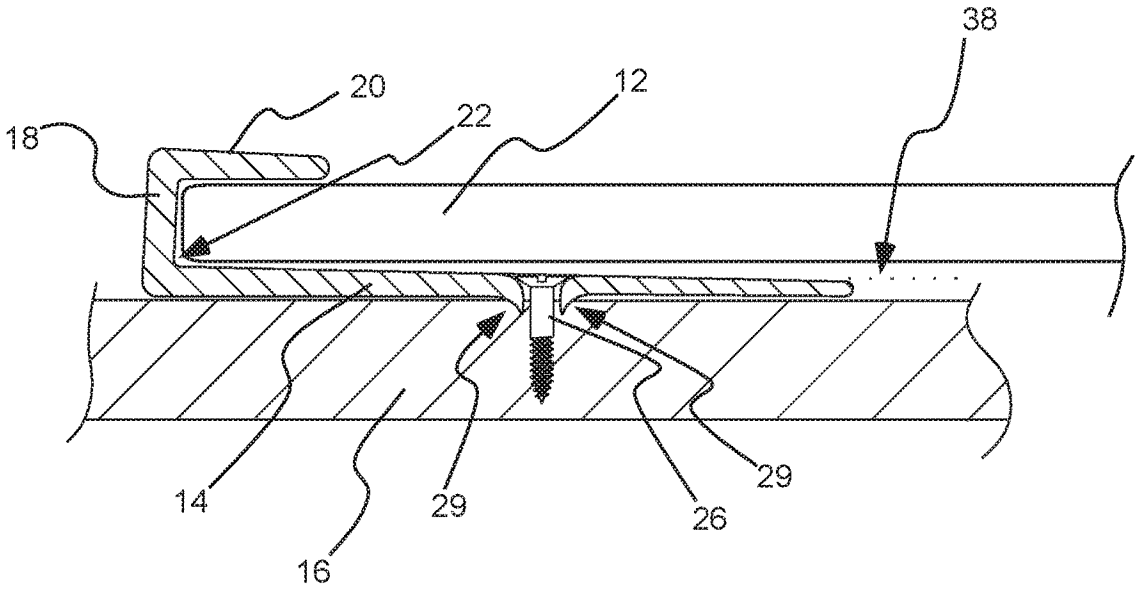
FIG. 2 is a partially sectioned view of the profile of FIG. 1, shown attached to a base surface with a veneer component installed therein.
Figure 3C:
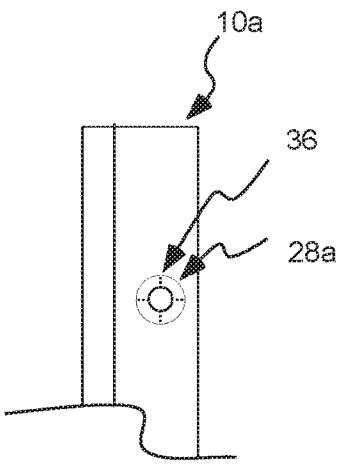
FIG. 3C is a top view of a portion of another embodiment of a profile in accordance with FIG. 3A.
Figure 3B:
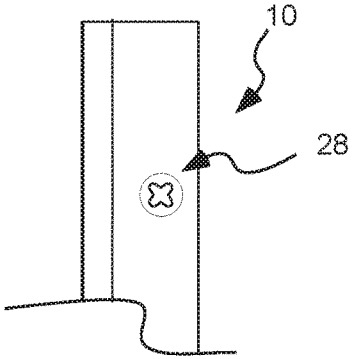
FIG. 3B is a top view of a portion of one embodiment of a profile in accordance with FIG. 3A.

In the embodiment illustrated in FIG. 2, the material of the deformation region 28 has been deformed during installation of the fastener 26. In this manner, portions 29 of the deformation region are securely embedded in the base surface 16 during installation of the fastener 26. After the fastener has been so secured, the veneer component 12 can be installed within the receiving pocket 22. As best shown in Detail A of FIG. 1A, in the embodiment shown in FIGS. 1A and 3B, the deformation region can include a series of teeth 30 extending from an outer section of the deformation region inwardly toward the fastener opening 24. In the initial condition (e.g., prior to securing the fastener through the fastener opening) the teeth assume the same planar arrangement of the fastener leg 14. As the fastener is rotated and forced downward due to the threaded engagement with base surface 16, an underside 34 of the head of the fastener 32 (see FIG. 3A) contacts the deformation region and forces it downward. This results in material deformation in that region, achieving optimal engagement with the base surface.

Material selection and size of the profile 10, as well as the fastener openings 24 and deformation region 28, can vary. In one exemplary embodiment, the profile is provided with a length "L" on the order of about 2500 mm (98.4 inches). A thickness "T" of the fastener leg 14, measured near the deformation region, can be about 0.7 mm (0.028 inches). A depth "D" of the profile can be on the order of about 22 mm (0.87 inches). As shown in Detail A of FIG. 1A, the fastener opening can have a diameter "$D_i$" of about 3.5 mm (0.138 inches). Bases of the teeth 30 can be arranged on a diameter "Do" of about 7 mm (0.276 inches). In one aspect, the profile can be formed from anodized aluminum. Using these exemplary dimensions, it has been found that a number 6 wood screw performs well in both securing the fastening leg 14 to the base surface 16 and at deforming the material of the deformation region 28 as intended.

As possibly best seen in FIG. 1B, in one aspect of the technology, the deformation region 28 has a flat profile prior to introduction of the fastener 26 through the fastener opening 24. In this manner, substantially all material of the deformation region is flush with or above a lower surface 14*b* of the fastener leg prior to engagement of the base surface 16 with the fastener 26. As this lower surface of the fastener leg is smooth across the deformation region, the fastener leg can be smoothly slid across the base surface and easily positioned where desired.

Similarly, substantially all material of the deformation region 28 can be flush with or below an upper surface 14*a* of the fastener leg 14 prior to engagement of the base surface 16 with the fastener. As this upper surface of the fastener leg is smooth across the deformation region, a veneer component or material can be smoothly slid across the fastener leg and easily positioned where desired before attachment of the fastener leg. In the example shown, the fastener can be installed such that an uppermost portion of the fastener head 32 is installed flush with or below the upper surface of the fastener leg. Thus, even after attachment of the fastening leg to the base surface, the veneer component can be easily slid into the receiving pocket 22 and easily adjusted lengthwise or laterally within the receiving pocket.

While not so required, in one aspect of the invention, the fastener opening 24 can include an inside diameter "$D_i$" that is about equal to or larger than an outside diameter of the threads or shank portion of the fastener 26. In this manner, the deformation region is not deformed by installation of the fastener through the fastener opening, but is rather deformed by pressure applied to the deformation zone by the underside 34 of the head 32 of the fastener as the fastener is forced into the base surface 16.

The deformation region 28 can be created in the fastening leg 14 in a variety of manners. In the embodiment illustrated in FIGS. 1A and 3B, the deformation region includes a series of teeth 30 that deform as the fastener is driven into the base surface 16. These teeth can be formed in the fastening leg via a punch process, taking care in some embodiments to maintain the overall flatness of the fastening leg. In the embodiment illustrated in FIG. 3C, for example, profile 10*a* includes a deformation region 28*a* that can include a series of weakened zones 36 formed in the fastening leg adjacent the fastener opening. These weakened zones can be formed in a variety of manners and can include a series of slits formed in the fastener leg material, or a series of perforations. These weakened zones may or may not form clearly visible breaks in the material of the fastening leg. However, sufficient weakness is introduced by their presence in the material of the fastening leg so as to result in the deformation region deforming as the fastener 26 is driven into the base surface 16.

Figure 4B:
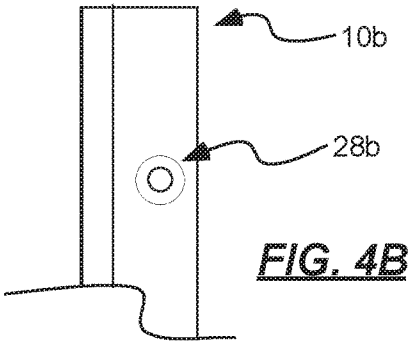
FIG. 4B is a top view of a portion of a profile in accordance with one embodiment of FIG. 4A.
Figure 3A:
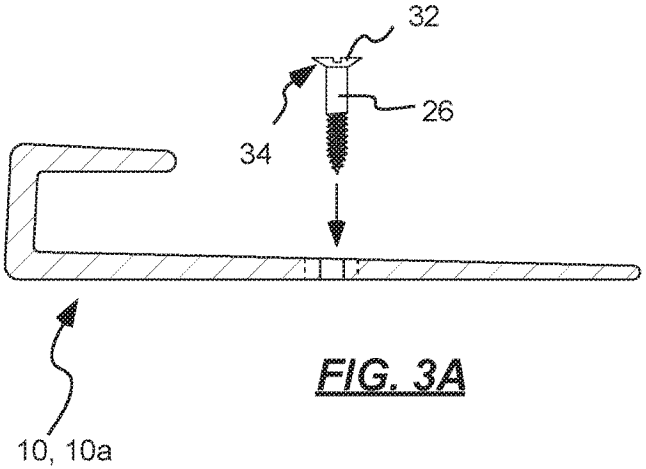
FIG. 3A is an end view of a section of another profile in accordance with an embodiment of the technology.
Figure 4A:
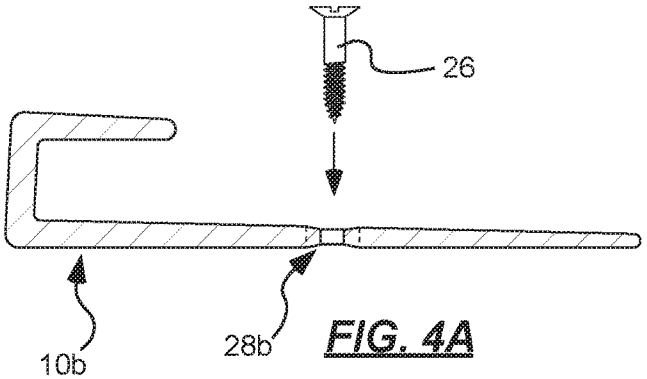
FIG. 4A is an end view of a section of another profile in accordance with an embodiment of the technology.

As referenced earlier, the deformation region 28 can include a thickness that is substantially the same as a thickness of the fastening leg 14 adjacent the fastener opening 24. In the embodiment illustrated in FIGS. 4A and 4B, however, profile 10*b* includes a deformation zone 28*b* that includes a thickness that is smaller than a thickness of the fastening leg 14 adjacent the fastener opening 24. This smaller cross section can achieve deformation without requiring that teeth or weakened slots or perforations be formed in the fastening leg material. In addition to, or alternately, the deformation region can include a material differing from a material of the fastening leg adjacent the fastener opening. For example, the deformation region can be formed by inserting into the deformation region a material weaker than the surrounding fastening leg material.

Figure 5:
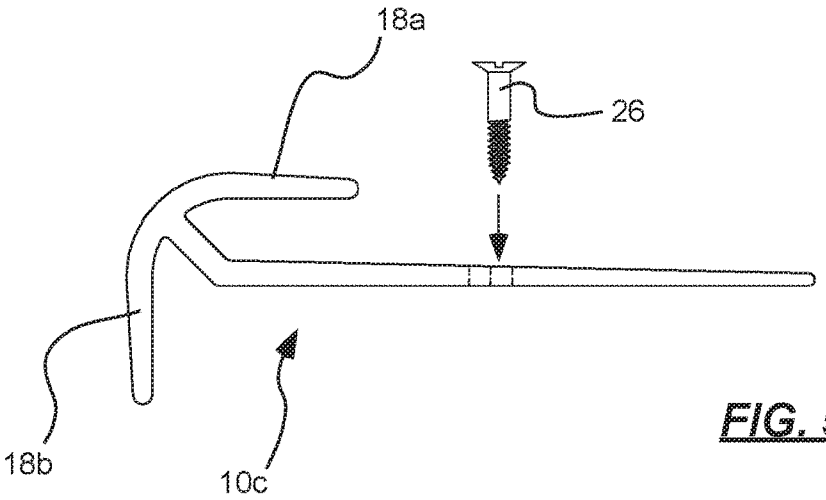
FIG. 5 is an end view of another profile in accordance with an aspect of the technology.
Figure 6:
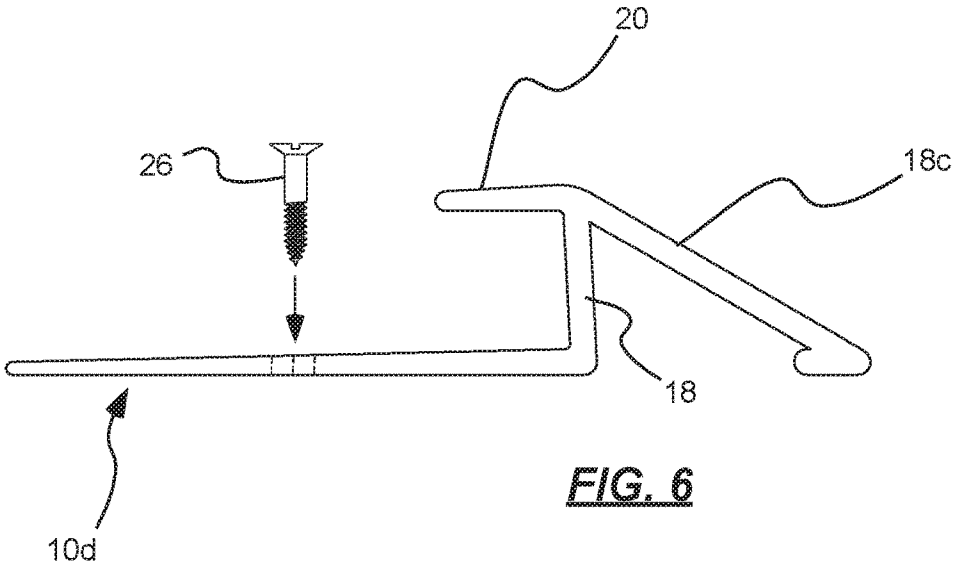
FIG. 6 is an end view of another profile in accordance with an aspect of the technology.
Figure 7:
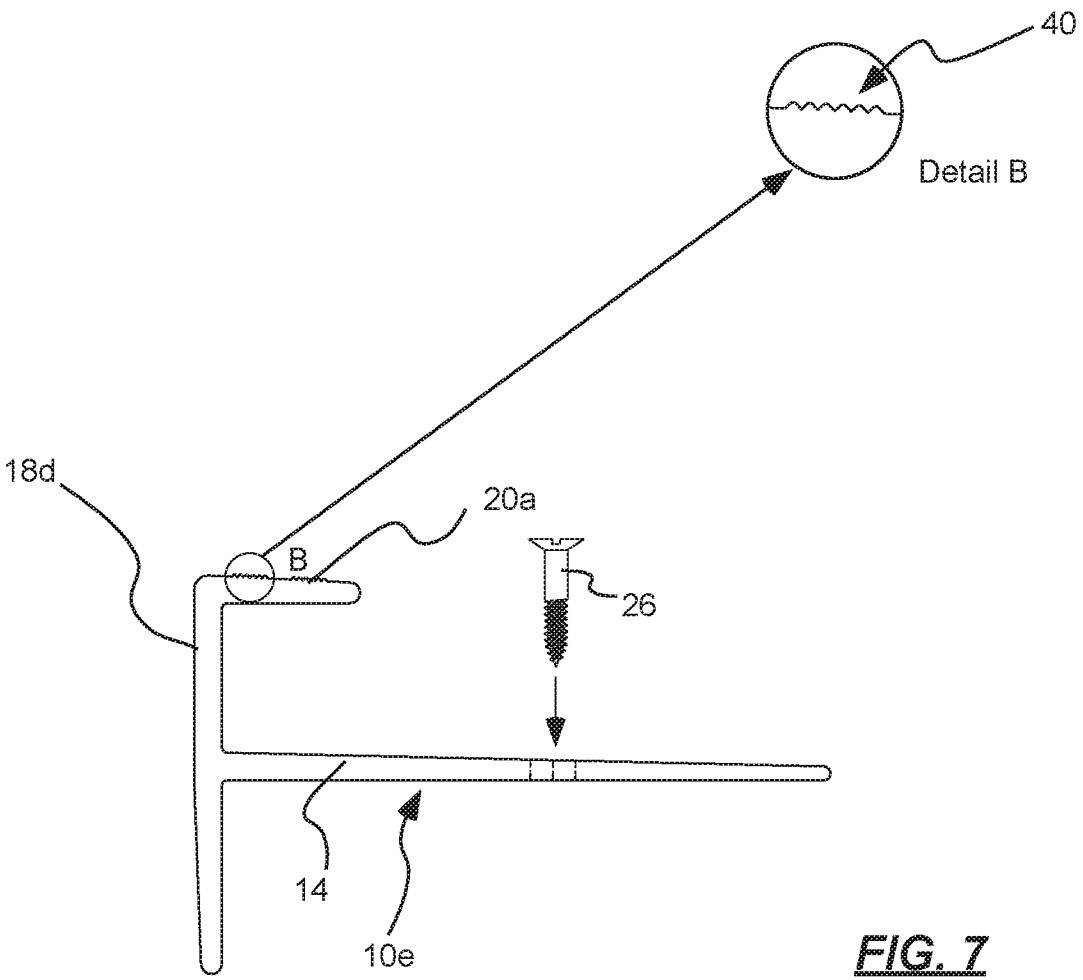
FIG. 7 is an end view of another profile in accordance with an aspect of the technology.

FIGS. 5-7 illustrate varying arrangements of profiles in accordance with alternate embodiments of the technology. In the example shown in FIG. 5, profile 10*c* includes a pair of edge legs 18*a*, 18*b*. Profile 10*c* can be advantageously used in applications where veneer components are installed on two base surfaces that meet in an outside corner. In the example shown in FIG. 6, profile 10*d* includes an edge leg 18*c* that extends downwardly from an upper portion of edge leg 18. This embodiment can be advantageously used in applications where the veneer component is installed at a higher elevation than an adjacent surface. In the example shown in FIG. 7, profile 10*e* can be advantageously used in applications such as stair treads. The cover leg 20*a* in this example can include a series of ridges or serrations 40 that can improve a frictional interface for a user walking on the profile. Edge leg 18*d* can extend below fastening leg 14 to provide a more secure engagement with an edge of a base surface (e.g., stair tread).

In addition to the structural features discussed above, the present technology can also provide a method of installing an elongate profile for terminating one or more veneer components above a base surface. The method can include positioning a fastening leg of the profile against a base surface, the profile including an edge leg extending from the fastening leg and being configured to provide a covering edge for a veneer component installed against the fastening leg. A fastener can be installed into the base surface through a fastener opening formed through the fastening leg. A head of the fastener can engage a deformation region formed in the fastening leg adjacent the fastener opening to thereby deform at least a portion of the deformation region as the fastener is driven into the base surface through the fastener opening such that at least a portion of material of the deformation region extends into and engages the base surface as the fastener is driven into the base surface.

In one aspect, the deformation region can include a flat profile prior to introduction of the fastener through the fastener opening such that substantially all material of the deformation region is flush with or above a lower surface of the fastener leg prior to engagement of the base surface with the fastener. Installing the fastener can include positioning an uppermost portion of the fastener substantially flush with or below an upper surface of the fastener leg. The fastener opening can include an inside diameter larger than an outside diameter of the fastener. The base surface can be at least partially formed from a wooden material, and installing the fastener can include installing a wood screw in the base surface.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

We claim:

1. An elongate profile installation for terminating a veneer component, comprising:

a fastening leg installed against a base surface;

an edge leg, extending from the fastening leg and being configured to provide a covering edge for a veneer component installed against the fastening leg, the fastening leg including at least one fastener opening formed therethrough prior to the introduction of a fastener, the fastener opening receiving a fastener therethrough such that the fasteners couples the fastening leg to the base surface as it extends through the fastener opening and engages the base surface, an uppermost portion of a head of the fastener being substantially flush with an upper surface of the fastening leg; and a deformation region formed in the fastening leg adjacent the fastener opening, the deformation region being deformed by the fastener as it was driven into the base surface through the fastener opening such that at least a portion of material of the deformation zone extends into the base surface after the fastener has been driven into the base surface; wherein a lower surface of the deformation region has a flat profile prior to introduction of the fastener through the fastener opening such that substantially all material of the deformation region is flush with or above a lower surface of the fastening lea prior to engagement of the base surface with the fastener.

2. The profile of claim 1, wherein substantially all material of the deformation region is flush with or below an upper surface of the fastening leg prior to engagement of the base surface with the fastener.

3. The profile of claim 1, further comprising a cover leg, extending from the edge leg in a direction substantially parallel with the fastening leg, the cover leg and the fastening leg collectively defining a receiving pocket in which a veneer component can be positioned.

4. The profile of claim 1, wherein the deformation region includes a series of teeth extending from an outer section of the deformation region inwardly toward the fastener opening.

5. The profile of claim 1, wherein the deformation region includes a series of weakened zones formed in the fastening leg adjacent the fastener opening.

6. The profile of claim 1, wherein the deformation region includes a thickness, and wherein the thickness of the deformation region is substantially the same as a thickness of the fastening leg adjacent the fastener opening.

7. The profile of claim 1, wherein the deformation region includes a thickness, and wherein the thickness of the deformation region is smaller than a thickness of the fastening leg adjacent the fastener opening.

8. The profile of claim 1, wherein the deformation region includes a material differing from a material of the fastening leg adjacent the fastener opening.

9. An elongate profile installation for terminating a veneer component, comprising:

a fastening leg installed against a base surface;

an edge leg, extending from the fastening leg and being configured to provide a covering edge for a veneer component installed against the fastening leg;

the fastening leg including at least one fastener opening formed therethrough, the fastener opening receiving a fastener therethrough such that the fastener couples the fastening leg to the base surface as it extends through the fastener opening and engages the base surface, an uppermost portion of a head of the fastener being substantially flush with an upper surface of the fastening leg;

a deformation region formed in the fastening leg adjacent the fastener opening, the deformation region being deformed by the fastener as it was driven into the base surface through the fastener opening such that at least a portion of material of the deformation zone extends into the base surface after the fastener has been driven into the base surface;

the deformation region including a series of teeth extending from an outer section of the deformation region inwardly toward the fastener opening; and a lower surface of the deformation region including a flat profile prior to introduction of the fastener through the fastener opening such that substantially all material of the deformation region is flush with or above a lower surface of the fastener leg prior to engagement of the base surface with the fastener.

10. The profile of claim 9, wherein substantially all material of the deformation region is flush with or below an upper surface of the fastener leg prior to engagement of the base surface with the fastener.

11. The profile of claim 9, further comprising a cover leg, extending from the edge leg in a direction substantially parallel with the fastening leg, the cover leg and the fastening leg collectively defining a receiving pocket in which a veneer component can be positioned.

12. The profile of claim 9, wherein the deformation region includes a series of weakened zones formed in the fastening leg adjacent the fastener opening.

13. The profile of claim 9, wherein the deformation region includes a thickness, and wherein the thickness of the deformation region is substantially the same as a thickness of the fastening leg adjacent the fastener opening.

14. The profile of claim 9, wherein the deformation region includes a thickness, and wherein the thickness of the deformation region is smaller than a thickness of the fastening leg adjacent the fastener opening.

15. A method of installing an elongate profile for terminating one or more veneer components above a base surface, the method comprising:

positioning a fastening leg of the profile against a base surface, the profile including an edge leg extending from the fastening leg and being configured to provide a covering edge for a veneer component installed against the fastening leg;

installing a fastener into the base surface through a fastener opening formed through the fastening leg such that an uppermost portion of a head of the fastener is substantially flush with an upper surface of the fastening leg, the fastener opening formed through the fastening leg prior to introduction of the fastener; and engaging with a lower portion of the head of the fastener a deformation region formed in the fastening leg adjacent the fastener opening to thereby deform at least a portion of the deformation region as the fastener is driven into the base surface through the fastener opening such that at least a portion of material of the deformation region extends into and engages the base surface as the fastener is driven into the base surface;

wherein a lower surface of the deformation region has a flat profile prior to introduction of the fastener through the fastener opening such that substantially all material of the deformation region is flush with or above a lower surface of the fastener leg prior to deformation of the at least a portion of material of the deformation region into the base surface.

16. The method of claim 15, wherein the fastener opening includes an inside diameter equal to or larger than an outside diameter of the fastener shank or threads.

17. The method of claim 16, wherein the base surface is at least partially formed from a wooden material, and wherein the fastener comprises a wood screw.

* * * * *